US009359704B2

(12) United States Patent
Plata Amarillas et al.

(10) Patent No.: US 9,359,704 B2
(45) **Date of Patent: *Jun. 7, 2016**

(54) HIGH ENERGY EFFICIENCY WASHING SYSTEM

(71) Applicant: MABE, S.A. DE C.V., Santiago de Queretaro, Queretaro (MX)

(72) Inventors: Santiago Alonso Plata Amarillas, Santiago de Queretaro (MX); Raul Santillan Galvan, Santiago de Queretaro (MX); Jorge Vega Trejo, Santiago de Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 270 days.

This patent is subject to a terminal disclaimer.

(21) Appl. No.: 14/057,162

(22) Filed: Oct. 18, 2013

(65) Prior Publication Data

US 2014/0041419 A1 Feb. 13, 2014

Related U.S. Application Data

(62) Division of application No. 12/712,293, filed on Feb. 25, 2010, now Pat. No. 8,701,450.

(30) Foreign Application Priority Data

Feb. 27, 2009 (MX) ..... MX/a/2009/002334

(51) Int. Cl.

| | |
|---|---|
| ***D06F 37/14*** | (2006.01) |
| ***D06F 17/10*** | (2006.01) |
| ***D06F 17/08*** | (2006.01) |

(52) U.S. Cl.
CPC ..... *D06F 37/14* (2013.01); *D06F 17/08* (2013.01); *D06F 17/10* (2013.01)

(58) Field of Classification Search
CPC ..... D06F 37/14; D06F 17/08; D06F 17/10
See application file for complete search history.

(56) References Cited

U.S. PATENT DOCUMENTS

| | | | | |
|---|---|---|---|---|
| 2,076,280 A | | 4/1937 | Schroeder | |
| 5,353,612 A | * | 10/1994 | Noguchi | D06F 33/02 68/12.02 |
| 5,509,283 A | | 4/1996 | Lee et al. | |
| 5,661,989 A | | 9/1997 | Jeon et al. | |

(Continued)

FOREIGN PATENT DOCUMENTS

CN 1508320 A 6/2004

*Primary Examiner* — Joseph L Perrin
(74) *Attorney, Agent, or Firm* — Terry M. Sanks, Esq.; Beusse Wolter Sanks & Maire, PLLC

(57) ABSTRACT

A washing machine containing a tub and basket placed within the tub, a basket bottom, a driving shaft coupled to the basket, a motor coupled to the driving shaft, a propeller located within the bottom and impelled by an end of the driving shaft, the propeller containing a scrubber, a center and a support, the scrubbers have a transversal section made from at least three arch circumference sections; a lower face of the propeller has a fin, which along with the bottom, functions as a centrifugal pump creating a current or washing liquor flow which is led through the water tower. In a preferred embodiment, the driving shaft has a solar gear coupled thereto which rotates a satellite gear and over the upper face of the support and between the scrubbers a mini-propeller is provided, the satellite gear is coupled to an axis that rotates the mini-propeller.

18 Claims, 15 Drawing Sheets

(56) References Cited

U.S. PATENT DOCUMENTS

| | | | | |
|---|---|---|---|---|
| 5,680,780 | A | 10/1997 | Kim et al. | |
| 5,727,404 | A | 3/1998 | Cho | |
| 5,794,633 | A | 8/1998 | Song | |
| 5,839,300 | A | 11/1998 | Yoon et al. | |
| 5,849,182 | A | 12/1998 | Shin | |
| 5,850,750 | A | 12/1998 | Cho | |
| 5,858,220 | A | 1/1999 | Shin | |
| 5,863,423 | A | 1/1999 | Shin et al. | |
| 5,931,027 | A | 8/1999 | Shin | |
| 5,950,460 | A | 9/1999 | Oh | |
| 5,989,418 | A | 11/1999 | Shin | |
| 6,076,378 | A | 6/2000 | Shin | |
| 2003/0200774 | A1 | 10/2003 | Kim et al. | |
| 2008/0216518 | A1 | 9/2008 | Yoo et al. | |
| 2008/0216519 | A1 | 9/2008 | Yoo et al. | |
| 2008/0216520 | A1 | 9/2008 | Yoo et al. | |
| 2008/0216522 | A1* | 9/2008 | Yoo | D06F 39/10 68/18 F |
| 2008/0216523 | A1* | 9/2008 | Yoo | D06F 39/10 68/212 |
| 2008/0217243 | A1* | 9/2008 | Yoo | D06F 39/10 210/636 |

* cited by examiner

Fig. 8
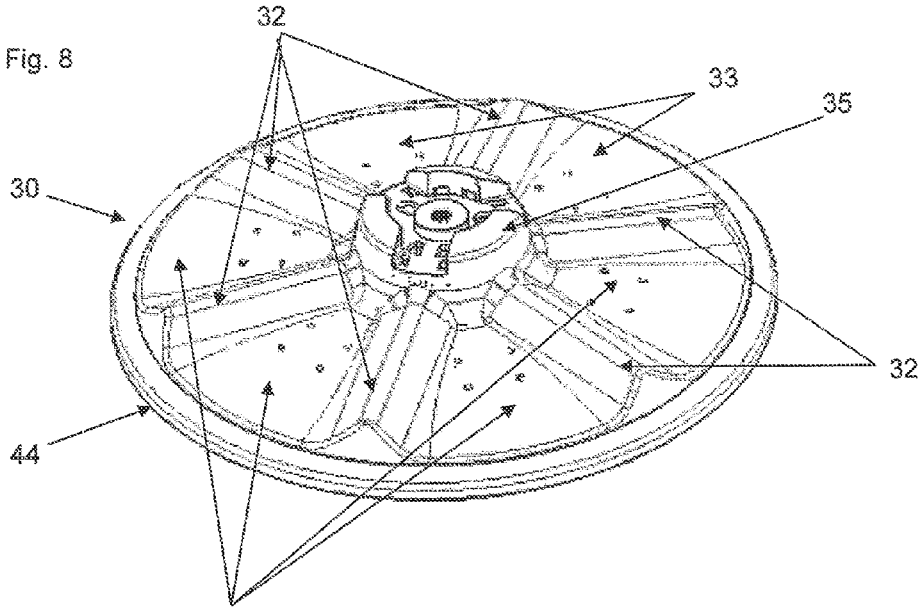
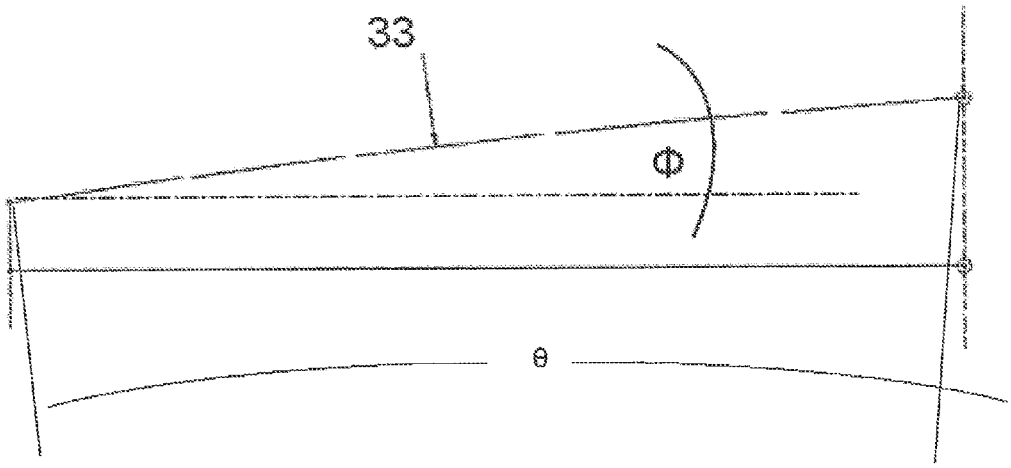
Fig. 9

HIGH ENERGY EFFICIENCY WASHING SYSTEM

RELATED APPLICATIONS

This application is a Division of U.S. application Ser. No. 12/712,293 filed on Feb. 25, 2010 which in turn claims priority from Mexican Patent Application No. MX/a/2009/002334 filed on filed Feb. 27, 2009, each of which is incorporated in its entirety herein by reference.

FIELD OF THE INVENTION

The present invention falls within the field of automatic cloth washing machines, in particular vertical axis washing machines having a propeller as a means to transmit energy to the liquid or washing liquor and articles within the basket.

DESCRIPTION OF THE RELATED ART

The vertical axis washing machines having a propeller have a peculiar construction. In said washing machines, a tub housing a basket is present, wherein in the bottom of the basket a propeller is disposed, which receives its impulse from a shaft which is mechanically coupled to a motor. The impeller task is transmitting energy to the washing liquor and to the articles within the basket. The task of the propeller is not only the transmission of energy to the washing liquor, but also creating a water current in vortex, that allows making that liquid currents pass through the deposited articles in the washing basket. This also causes the textiles or objects which are deposited for washing in the washing basket, to be dragged through the vortex, making the articles to be washed change position with regards to the washing basket, and making the articles emerge to the surface to later be sucked, repeating this phenomena during the whole washing stage.

This phenomena allows that when a determined object to wash is sucked, the vortex will direct this object towards the propeller. The scrubbers in the propeller will have direct contact with the object to wash, helping thus remove the filth in the objects to wash. On the other hand, the propeller in its lower part has a set of fins, which will function in a similar manner to the curved blades of a pump. The lower part of the propeller, along with the basket bottom forms a liquid pump, which generates a current that is directed through a water tower toward the upper part of the basket, in this manner, in the upper end of said water tower, a window is found, which allows washing liquor flow coming from the water tower to be sent to be deposited again to the inner part of the washing basket. In diverse occasions, this system is taken advantage of to trap lint generated in the washing process or diverse particles contained in the objects to wash, by means of a filter or mesh in a similar manner to a sock. This filter assembly may be removed to extract the lint or particles trapped therein.

Therefore, in view of the above, the need for more energetically efficient systems may be seen, that is, that with less energy the task of washing cloth is done, without mistreatment. Adding to this the simplification of the mechanical systems that require to provide speed and torque to the propeller; aspects that the present invention covers in a satisfactory manner, among others.

BRIEF SUMMARY OF THE INVENTION

A vertical axis top load washing machine with propeller, comprises a cabinet, to which shock absorbers are hanged from which the tub is held. Within said tub, a rotational basket is placed in a concentrical manner which has in the center of its lower base a hole through which a shaft passes, which in its upper end is coupled to the propeller. The free end of the shaft is traditionally coupled to a gear box, typically a planetary box, and this, is mated to a pulley system or directly to an electric motor.

When the impeller by means of creating a vortex is agitating the objects immersed in the washing liquor contained in the wash tub, the need for a high torque is foreseeable, taking into account that the impeller has to overcome the wash liquor inertia held by the objects to be washed. This is the reason why most of the solutions found in the state of the art lead to having in its mechanical system, a gear box, privileging the torque and dismissing the propeller rotation speed, thus the propeller for these systems has to be of greater dimensions in its components, specifically bigger geometry and number of fins, as well as bigger geometry and number of scrubbers to ensure good performance. This engineering contradiction is not desirable, specifically higher propeller speed could cause better currents or speeds of the fluid particles, which allows a better vortex with higher turbulent currents. This leads to redefining the geometry of the propeller in such a manner that it allows us to operate with a low torque and a high rotation speed. On the other hand, the propellers in their lower part along with the basket bottom simulate the functioning of a liquid pump sending washing liquor current towards the intake or lower part of the water tower. These components should also be taken into account to reduce the necessary propeller torque, specifically to move certain water flow through the tower is necessary to determine the torque which in many cases is high. Thus considering the water tower as a waterway and the lower part of the propeller along with the basket bottom as a pump, a design was conceived that allows moving a determined flow through the water tower with a low torque and high propeller speed.

Therefore, a high efficiency system for washing cloth is obtained, which has a propeller designed to operate with a low torque, at a high speed, as well as with a tower with softened curves, smooth inner surfaces, with a minimal friction loss, along with efficient fins or curved blades placed in the lower face of the propeller (which allows removing the gear box). This allows that the mechanical system does not require a gear box to achieve the desired washing performance of the washer, coupled then directly to the driving shaft in one end the propeller, and the free end being coupled with a driven pulley, which at its time is moved by a belt which obtains its kinetic energy from a driving pulley coupled to an electric motor. This efficient system allows operating with less parts, reducing the production cost of the system, making it more dependent when having less parts that may fail, and thus energetically more efficient when not having to transmit and transform the energy through a long chain of mechanisms.

BRIEF DESCRIPTION OF THE SEVERAL VIEWS OF THE DRAWINGS

FIG. 8 shows a conventional perspective upper view of the second embodiment of the invention.

FIG. 9 shows in detain the construction of the curved support of the propeller.

DETAILED DESCRIPTION OF THE INVENTION

Figure 1:
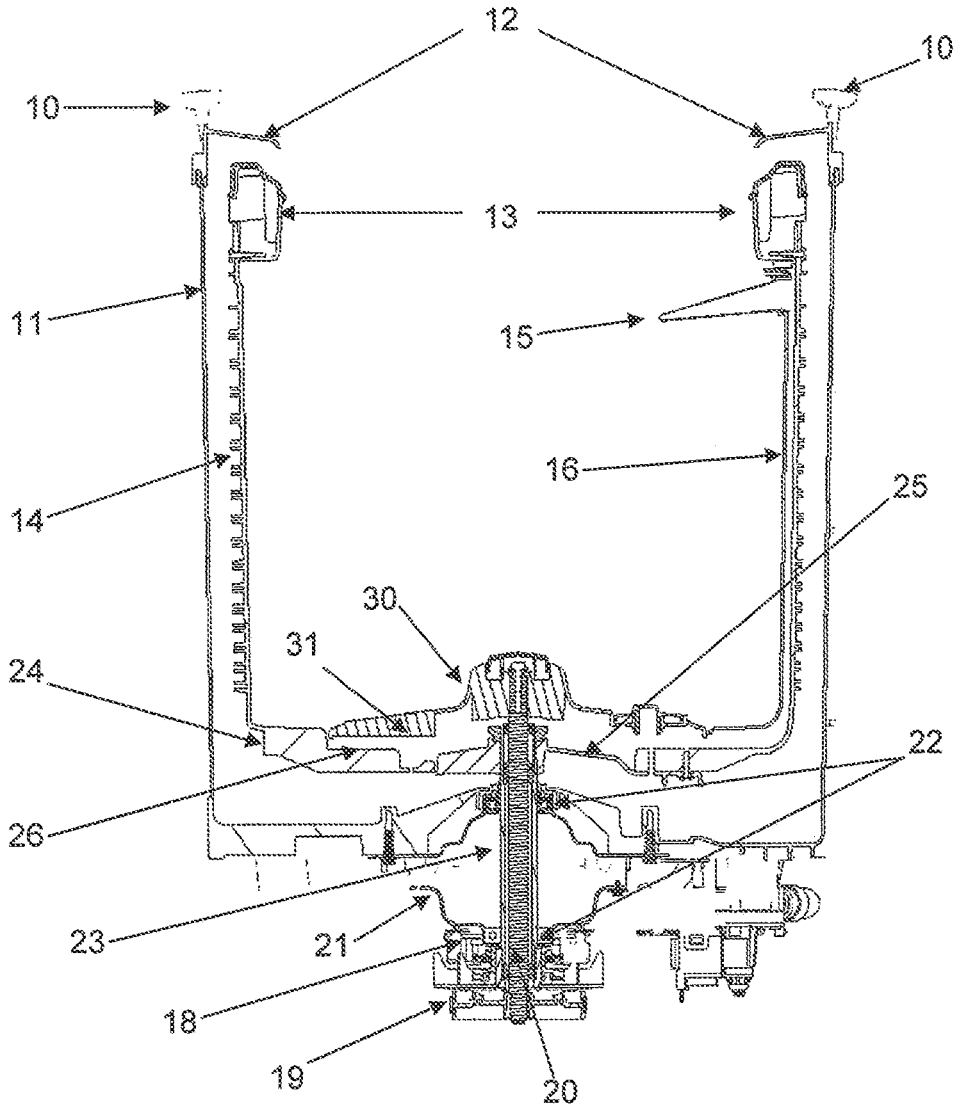
FIG. 1 shows a cross-section of a sub-washing machine.

FIG. 1 shows a cross-section of a vertical axis, top load washing machine with a propeller 30, that has a tub 11 supported to the cabinet by means of suspension rods 10. The tub is crowned with a cover 12 disposed concentrically. Within the tub 11 a basket 14 is found, which receives the articles or objects to wash. In the lower part of said basket 14, a bottom 24 is found, which contains a circular recession that forms the basket bottom 26. The tub bottom has a slightly bigger diameter than that of the propeller 30 which is partially housed within the basket bottom 26. A driving shaft 20 is fitted in the central inferior part of the impeller 30. The other end of driving shaft 20 is coupled to a pulley 19 driven by a belt, which in turn is been driven by a smaller pulley coupled to an electric motor 18. The driving shaft 20 rotates within the hollow shaft 23 and wherein the hollow shaft 23 is supported by rolling means 22, which should be separated a certain distance to allow giving rigidity to shafts 20 and 23. This separation and support is given by the motor support 21 over which the electric motor 18 is placed, which preferably is an alternate induction motor, reversible with double capacitor, but this may be inter-changed with any other type of electric motor, such as may be a direct current or variable speed, etc. Even the pulley coupled to the electric motor 18, the belt and the pulley 19, may be dispensed with if the electric motor 18 is coupled mechanically to the driving shaft 20, depending on the specific design of the tub, the control system, the cost range of the washing machine in the market, among other factors.

It is thus that the propeller 30 settled within the basket bottom 26 when rotated behaves as a liquid pump, given that in its lower face it has fins 31 which work as curved blades of a liquid centrifugal pump, which along with the basket bottom 26 generate a washing liquor current which is directed to the lower part of the water tower 16. The fins 31 lead the washing liquor to the upper part of the basket 14, wherein a window 28 allows the output of the washing liquor flow so that it returns to the rest of the washing liquor mass in the basket 14 in a similar manner to a fountain. It is in this window 28 in which a filter 15 may be disposed, which is made from a plastic textile in the manner of a mesh, commonly adopting the form of a sock. Thus when passing the washing liquor through the filter 15, this will trap the lint or large particles suspended in the washing liquor avoiding the re-disposition of lint or large particles over the objects to wash, thus assuring a good flow through the window 28 is important to be able to recollect the greatest quantity of suspended particles in the washing liquor.

Figure 2:
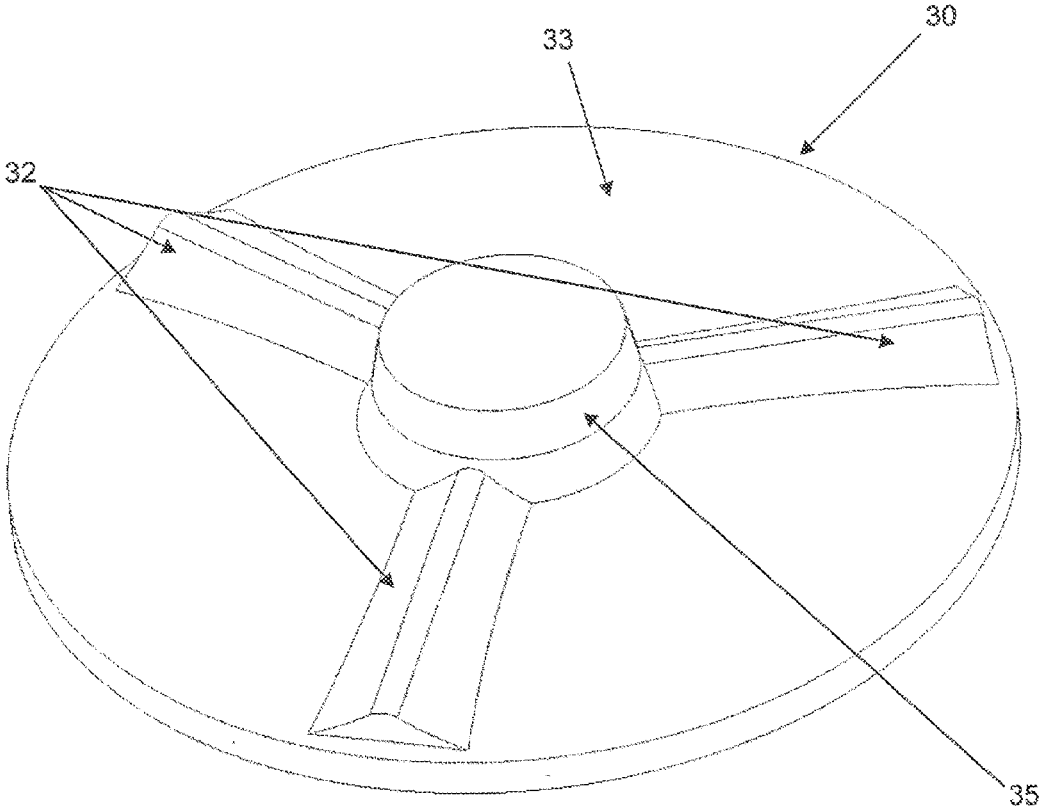
FIG. 2 shows a conventional perspective upper view of an embodiment of the propeller.

FIG. 2 illustrates a conventional perspective view of the propeller 30 with three scrubbers 32, which are built in high relief over a support 33. The scrubbers 32 have the task of transmitting energy to the washing liquor to form the vortex to drag the objects to wash. Furthermore, the scrubbers 32 should have contact with the objects to wash, creating friction between said objects to wash and said scrubbers 32. Looking for a scrubber design with low torque and high speed, the geometry of the scrubbers 32 is fundamental, since if these are too tall, further to being non-aerodynamic a high torque is required to move the propeller 30 from stand-still.

Figure 3:
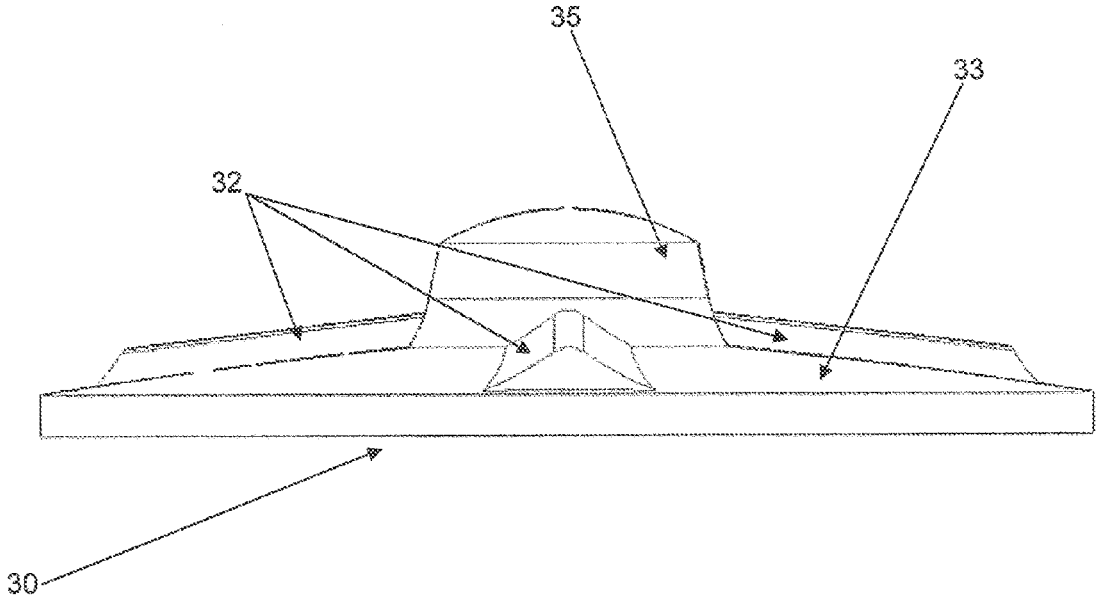
FIG. 3 shows a lateral view of the embodiment of the propeller of FIG. 2.

As may be appreciated in FIG. 3, the scrubbers have an aerodynamic shape, that is, they cannot be too high, and further the propeller body comprising the support 33 has a conic section configuration to allow the correct creation of a vortex, as well as allow the objects to be washed to be slid through this surface. These parameters are to be designed to obtain a low torque and high rotation speed propeller 30.

Figure 4:
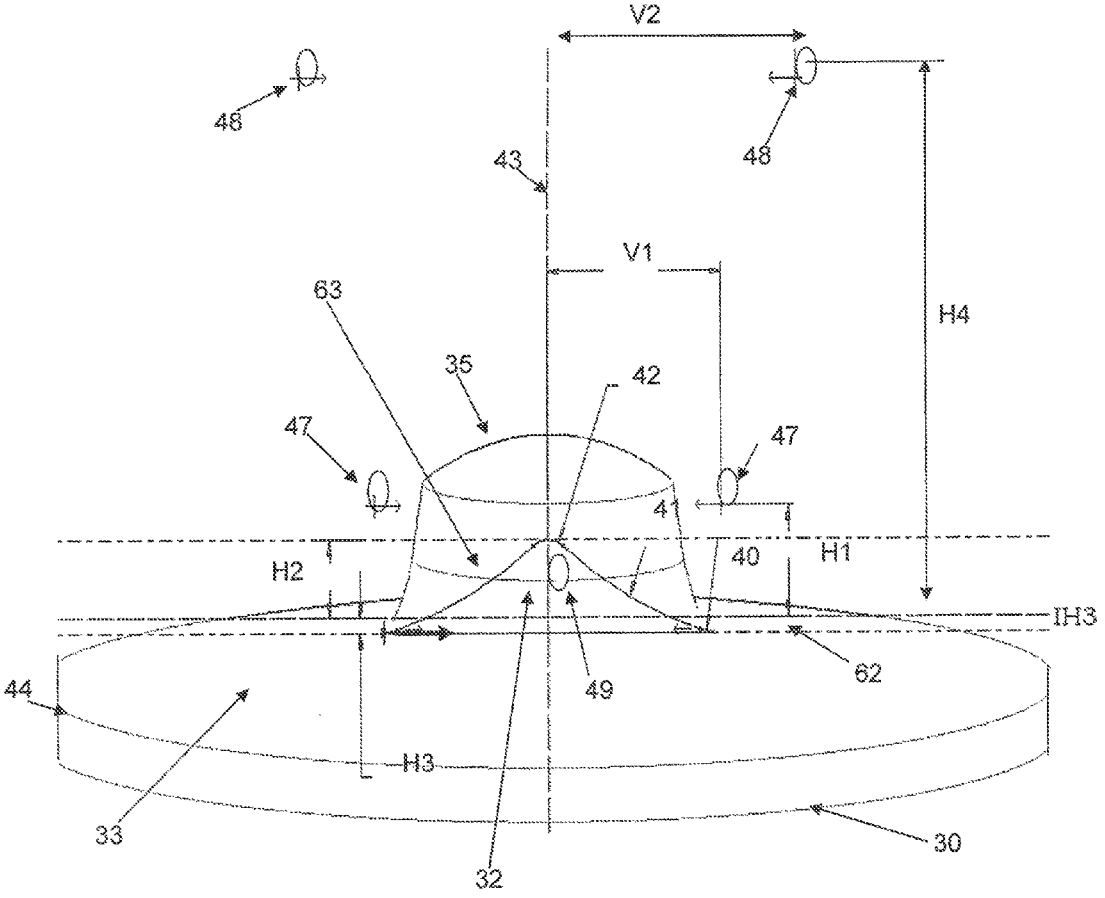
FIG. 4 shows a cross-section in detail of the propeller scrubber of FIG. 2.

FIG. 4 shows a cross-section of a scrubber 32 with detail of the geometry of the scrubber 32. Thus starting from the propeller 30 outer diameter 44, the scrubber 32 transversal geometry may be seen, which starts from a horizontal demarked by the propeller 30 outer diameter 44. Thus, the first curve is the foot 40 of the scrubber, the curve obeys an arch circumference equation whose radius oscillates between half a centimeter to three centimeters (0.197 in to 1.18 in), and whose center 47 should be located in coordinates V1, H1. This first curve has the function of allowing a soft curve through which the fluid or washing liquor particles, be leaded, so that said washing liquor particles slide and where possible to not collide, reducing thus the energy required by then propeller 30 to rotate. The following section is determined by a slope 41, which also follows the curve described by the circumference arch of seven centimeters to fifteen centimeters (2.76 in to 5.91 in) of radius, which should be located in coordinates V2, H4. The slide 41 allows the generation of the vortex, knowing that in functions as a curved blade in a centrifugal force, since given its outer area, as well as its curvatures, helps pushing the washing liquid generating thus the water currents, thus the necessary turbulence for the correct formation of the vortex in the washing liquor that drags the objects to be washed, so that these emerge to the surface, so that as a following act they may be sucked by said vortex, causing the objects to wash to circulate within the volume occupied by the washing liquor, exposing said objects to wash to that the currents of washing liquor pass through them dragging the filth between the fabrics. Furthermore, friction between the objects to wash is generated promoting the "scrubbing" effect between the objects to wash. It is for this reason that if the geometry is not correct, the required torque to move the propeller 30 from stand-still will considerably increase. The third geometry to consider in the scrubber 32 is the apex 42 joining the slopes 41. The transversal geometry of the scrubbers 32 is vertically symmetrical throughout the symmetry axis 43, thus, to join the slopes 41 located in each side of the symmetry axis 43, a curve is used, that describes the circumference arch whose radius oscillates between eight to fifteen millimeters (0.315 to 0.591 in), the apex 42 should have a soft curve that allows the objects to wash slide over this. The apex 42 experiments greater friction from the objects to wash, which should be blunt and should not comprise acute angles or constant vertices, since these may damage the objects to wash, and further allow a smooth slide of the washing liquor over the commented surface.

Figure 5:
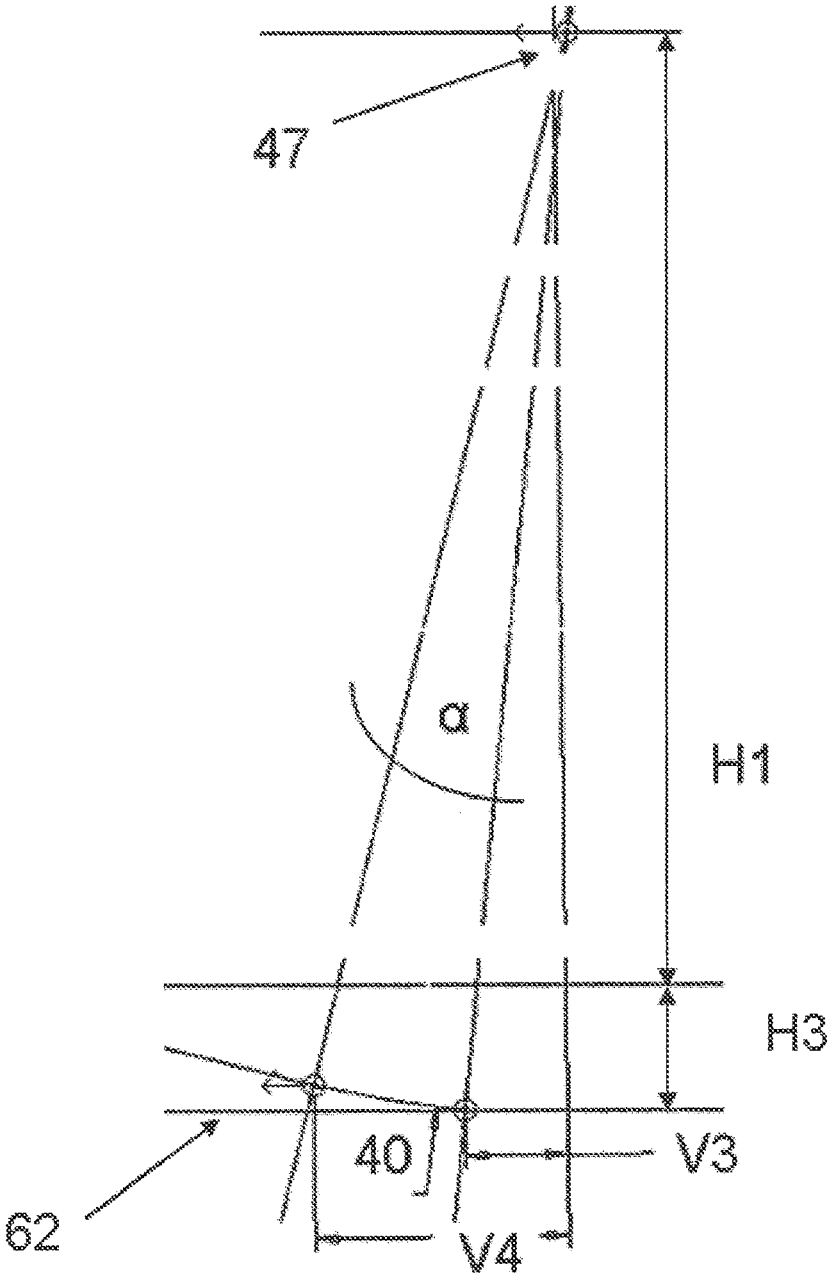
FIG. 5 shows in detail the construction of the arch of the foot of the scrubber.

FIG. 5, taken from the view at lines 47 of FIG. 4, shows the trace lines over which the foot 40 arch segment of the scrubber is built. Thus we locate coordinates V1, H1, wherein V1 is measured from the symmetry axis 43. H1 is measured height fixed by H3, measuring this at its time horizontally from the medium line 62, which is the start point of the arch foot 40 of the scrubber which is vertically found over the medium line 62, a distance V3 measured from the normal intersection with the medium line 62 and a vertical line that passes through point 47. The arch foot 40 of the scrubber has a final point V4 measured from the normal intersection with the medium line 62 and a vertical line that passes through point 47, describing thus angle α, preferably between five to twenty grades. Thus the radius of the arch foot 40 of the scrubber is in a range of between two to five centimeters (0.787 in to 1.97 in), being dimensions H1+H3 similar in magnitude to the radius of the arch foot 40 of the scrubber. V3 and V4 should have magnitudes in the range of a hundred millimeters to two centimeters (3.94 in to 0.787 in) each one.

Figure 6:
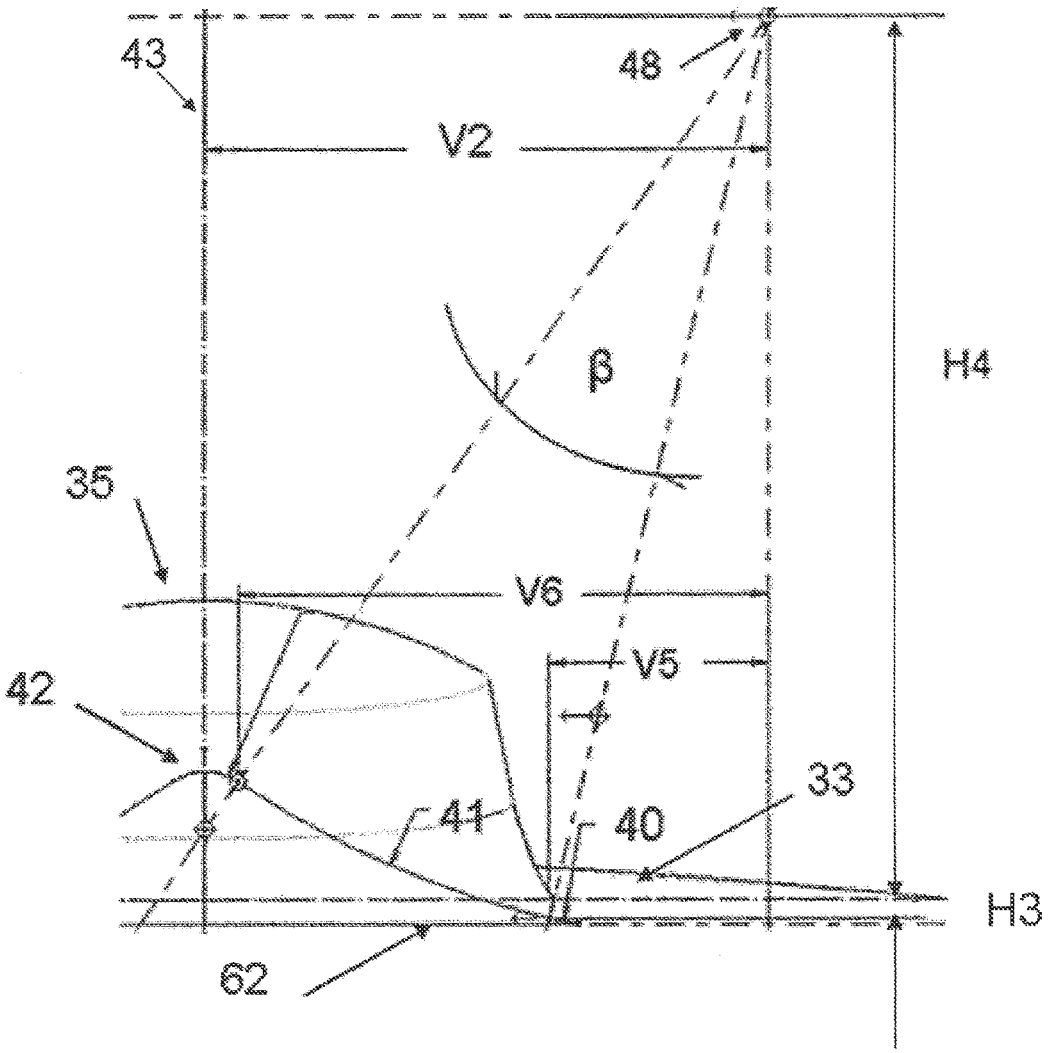
FIG. 6 shows in detail the construction of the slope arch of the scrubber.

FIG. 6, taken from the view of lines 48 of FIG. 4, helps locate point 48, which is the center of the arch slope 41, being coordinates of said point 48 V2, H4. The referred arch slope 41 extends from angle β, to thus locate the start point of the slope arch 41. A vertical line is traced from point 48 that normally intersects with medium line 62, from there a horizontal distance V5 is measured, this point coincides with the final point of the arch foot 40 of the scrubber, having as a final point the slope arch 41 referred to by height V6. Thus the magnitude V2 which is measured from the symmetry axis 43 preferably is in a range of five to twelve centimeters (1.97 in to 4.72 in). The magnitude of H4+H3 should be similar to the arch slope 41 radius which is comprised in a range of ten to twenty centimeters (3.94 to 7.87 in). The β angle oscillates between fifteen to thirty grades.

Figure 7:
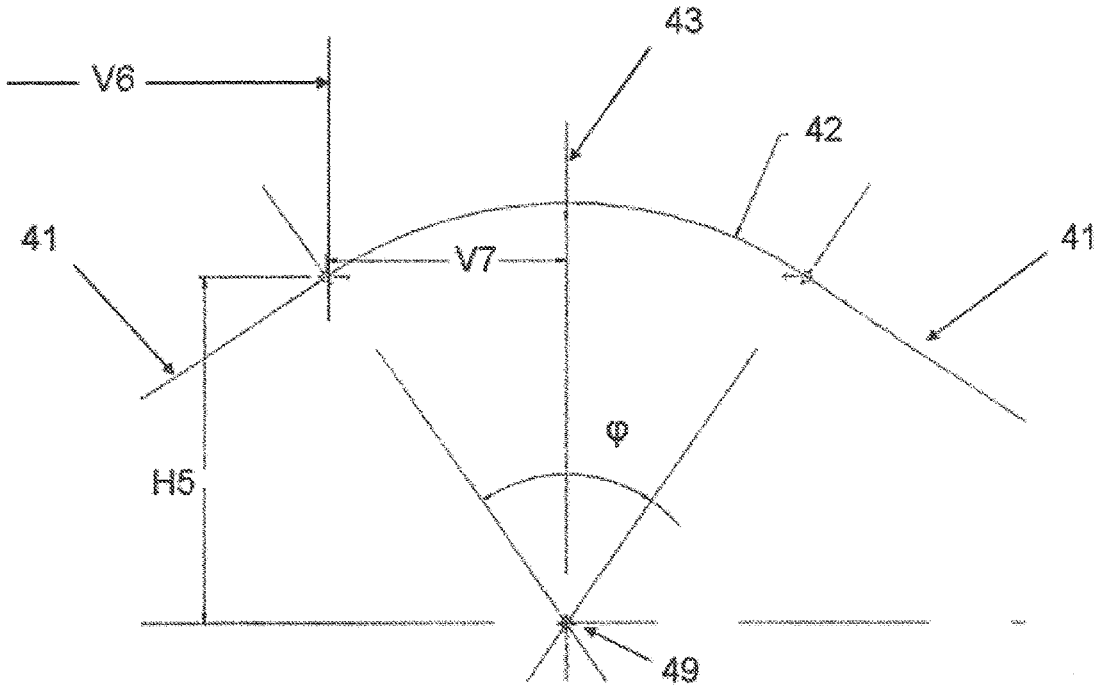
FIG. 7 shows in detail the construction of the apex arch of the scrubber.

FIG. 7 in view of FIG. 4 illustrates the geometry of apex 42. To be able to form this apex, point 49 is located, which has its vertical coordinate over symmetry axis 43 at a distance over H5 vertical from the final point of the slope arch 41 located by height V6. The same point may be located in view of height V7, which indicates the horizontal distance between the final point and the slope arch 41 and the symmetry axis 43. Thus the magnitude of the radius of the arch apex 42 is comprised in a range of three to ten millimeters (0.118 to 0.394 in). The height V7 thus has a magnitude between two to ten millimeters (0.0787 to 0.394 in). Height H5 should have a magnitude similar to the arch apex 42 radius, obtaining thus angle ϕ demarking by the final points the arch slope 41 to both sides of the symmetry axis 43, wherein angle ϕ will oscillate between forty to ninety degrees.

FIG. 9 shows the geometry that the support 33 follows, which in a preferred embodiment its surface follows a circumference arch with a radius that oscillates between a hundred and forty centimeters to two hundred twenty two centimeters (55.1 in to 87.4 in), with a θ angle which oscillates between the thirty to eighty degrees. In an alternate embodiment of the invention, the surface follows a smooth slope straight with an angle θ with the horizontal of between five to twenty five degrees, said straight joins the outer diameter 44 with the base diameter (DB) of the center 45, illustrated in FIG. 10, forming in both embodiments a conic section over which the scrubbers 32 protrude, as may be seen in FIGS. 8 and 10.

Figure 10:
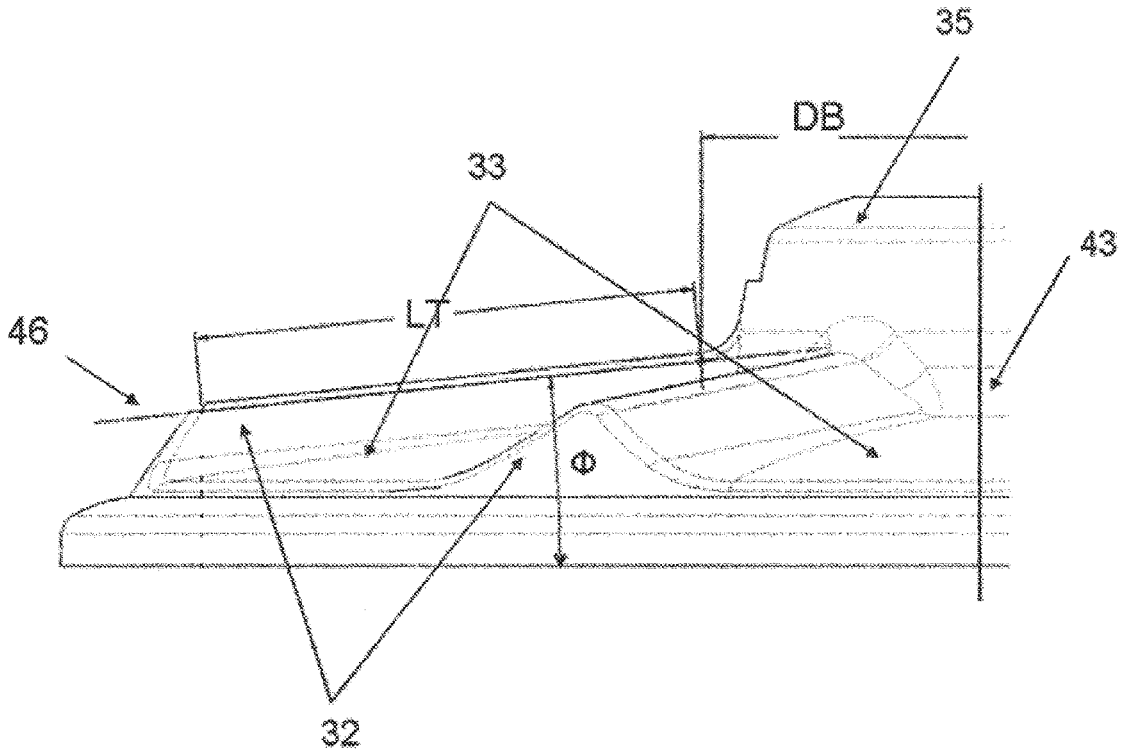
FIG. 10 shows in detail a lateral view of the second embodiment of the propeller of FIG. 8.

FIG. 10 also denotes the length (LT) of the scrubbers; these also follow a straight projection over axis 46, which has the same slope than that of surface of the apex 42. Forming the referred axis 46 an angle Φ with the horizontal, said scrubbers 32 have a determined length (LT) which is demarked by the propeller 30 outer diameter 44 and the center 35 base diameter (DB), being able, in any case being shorter than the referred limitation. The length of the scrubbers 32 will depend on the capacity of the washing machine, as well as the vortex type desired, further to the capacity or power of the electric motor 18, being these variables determined by the design of the own washing machine.

FIG. 8 shows an upper perspective view of the propeller 30 object of the present invention, wherein six scrubbers 32 are seen, being the number of these determined in function of the speed required for the propeller 30 to rotate. In the discussed system of the present invention it is required that the propeller 30 rotates at high rpm due to the absence of a transmission or gear reduction box that allows transforming the torque into speed. Thus if a driving shaft 20 is coupled directly to a motor 18 or a set of pulleys and belt, a high speed in the driving shaft 20 will be obtained at all times. Therefore, the number of scrubbers 32 required for the correct generation of the vortex is minimum three and maximum twelve. The number of these will depend on the design features as are outer diameter 44 which should be greater than fifteen centimeters (5.91 in), the center 45 diameter, angle Φ of the scrubbers 32, angle θ of the support 33 and the capacity of the washing machine among others. Therefore in the great majority of cases, determining the number of scrubbers 32 to use with the proposed geometry will be solved with experimentation as may be appreciated in the following Table I.

| Propeller Number | Scrubber Number | Fin Number | RPM | Load Condition | Cloth Movement Perception | Appreciation |
|---|---|---|---|---|---|---|
| 1 | 6 | 3 | 446.6 | Without Cloth | — | 7 |
| | | | 380 | 6 lb. | 7 | 5 |
| 2 | 6 | 6 | 438 | Without Cloth | — | 5 |
| | | | 370 | 6 lb. | 7 | 4 |
| 3 | 3 | 3 | 453.9 | Without Cloth | — | 8 |
| | | | 427 | 6 lb. | 8 | 6 |
| 4 | 3 | 6 | 446.1 | Without Cloth | — | 7 |
| | | | 421.2 | 6 lb. | 8 | 4 |
| 5 | 5 | 10 | 407 | Without Cloth | — | 10 |
| | | | 304 | 6 lb. | 5 | 3 |
| 6 | 5 | 0 | 478 | Without Cloth | — | 3 |
| | | | 393 | 6 lb. | 5 | 0 |

From Table I it may be perceived that the last two columns evaluate only subjective parameters, when granting a grade to the movement perception of the cloth as well as the liquor flow that emanates from the water tower 16. Therefore, according to the parameters used for the washing machine of the present invention, it is seen that the number of three or six scrubbers 32 functions satisfactory manner. Future evolutions showed that the number of scrubbers with the proposed geometry may oscillate between three to twelve scrubbers, taking into account that the greater number of scrubbers, the greater the required torque, as well as speed to generate the vortex diminishes, having also the inconvenience of having to evaluate the fin 31 dimensions disposed in the lower face of the propeller 30, in charge of generating water currents which will be led through the water tower 16. Said fins should be adequately dimensioned, since these also have repercussions over the torque and low speed which should operate the propeller 30. Thus, a high number of fins 31 causes using a high torque and low rpm's.

Figure 11:
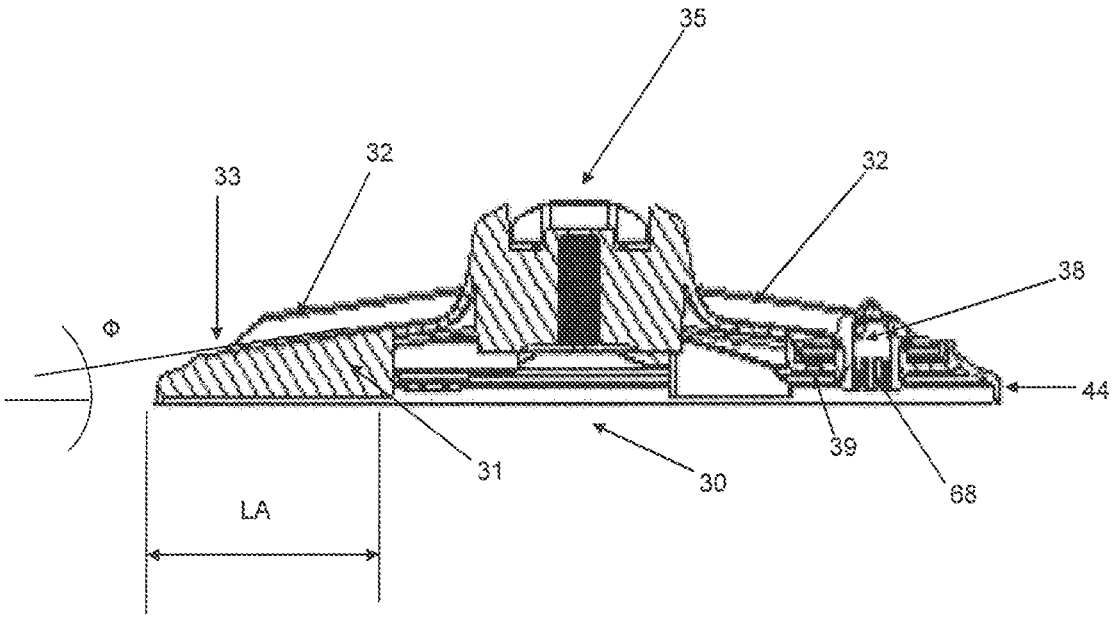
FIG. 11 shows a cross-section of the second embodiment of the propeller of FIG. 8.
Figure 13:
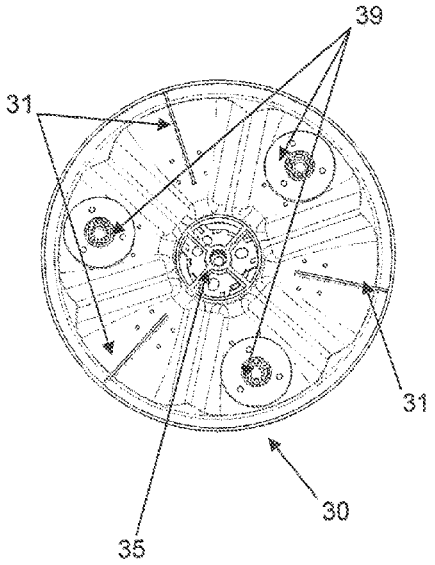
FIG. 13 shows a lower view of the third embodiment of the propeller.
Figures 14, 15:
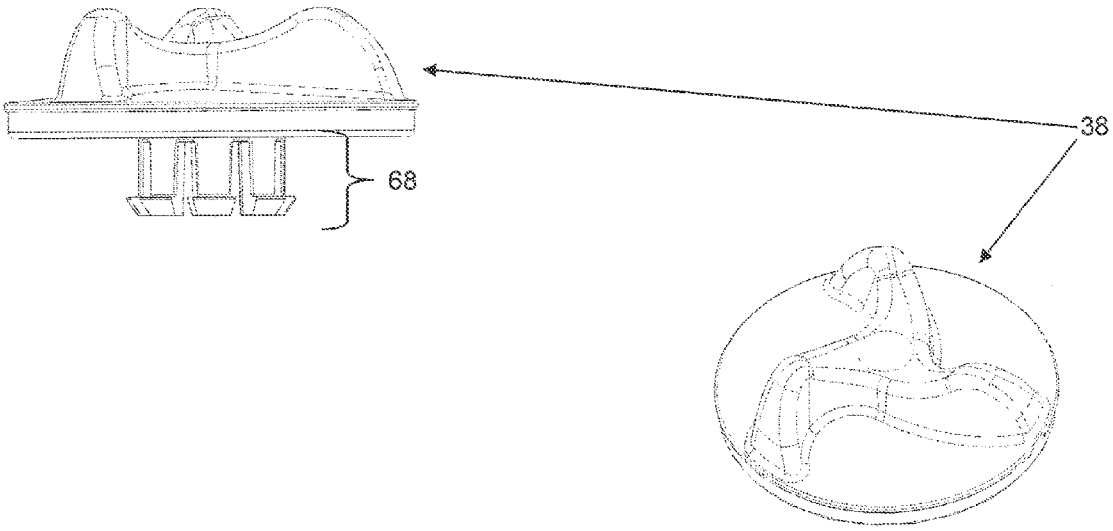
FIG. 14 shows a lateral view of the mini-propeller.
FIG. 15 shows a conventional perspective upper view of the mini-propeller.

Thus FIG. 11 allows seeing a cross-section of a propeller 30, in which the fin 31 geometry may be appreciated, which is defined in its upper part by the geometry of the own support 33, which in an alternate embodiment may have a slope with a Φ angle, being the fin 31 protruded from a rectangle section (see FIG. 13). From the lower surface of the referred support, forming thus a wall with constant thickness thirty to forty times thinner than the length (LA) of the fin 31, said length of the fin is constrained by the propeller 30 outer diameter 44 and center 35 diameter. It is preferred in the design to contemplate longer than higher fins 31, given that the longer fins 31 have a better radial contact area with the fluid or washing liquor 27, which increases the drag capacity within the basket bottom 26 causing thus a more uniform angular speed. On the other hand, shorter fins 31 demand less torque for their functioning, this is translated in that the propeller will require less torque to function, demanding less energy from the motor 18 and thus consuming less current, thus working colder.

Figure 17:
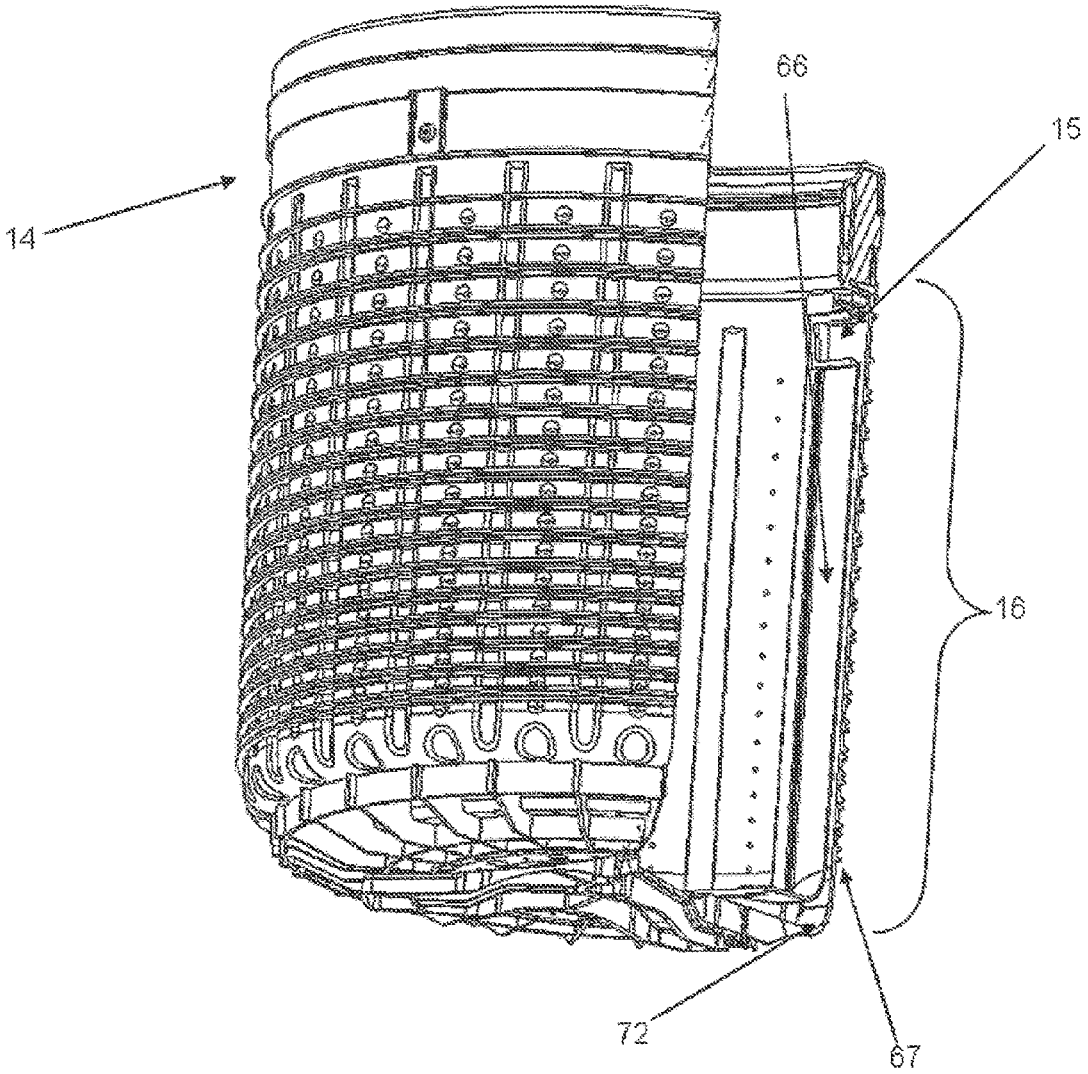
FIG. 17 shows a conventional perspective view of a longitudinal cut of the basket.
Figure 18:
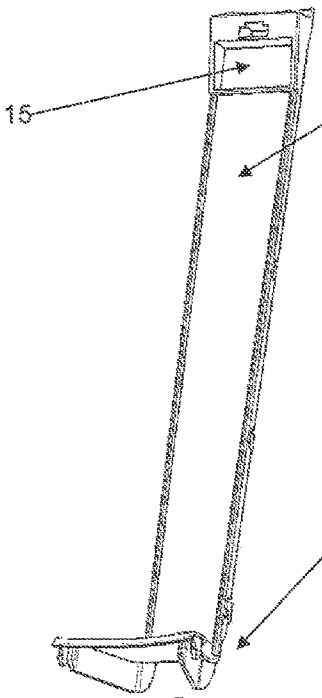
FIG. 18 shows a conventional perspective front view of the water tower cover.
Figure 19:
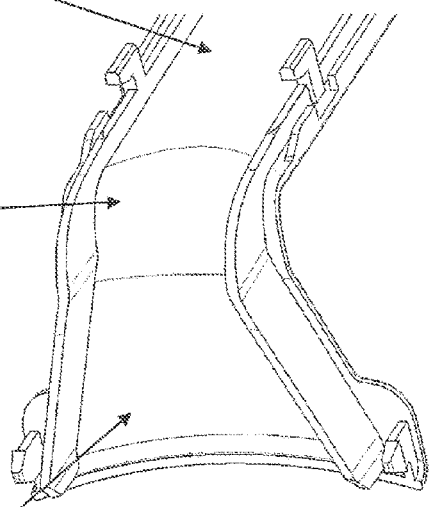
FIG. 19 shows a detail conventional perspective back view of the lower part of the water tower.

FIG. 17 helps visualize how the current in the lower face of the propeller 30 is generated, in view of the fins 31, and the basket bottom 26, that together resemble the functioning of a centrifuge pump. The fluid or washing liquor is channeled through the lower part of the water tower 16 which comprises a cover 66 that covers a channel 67 disposed over the surface of the peripheral wall of the basket 14. Said water tower 16 has smooth surfaces, an entry cavity 73, and smoothened nodes 72 illustrated in FIGS. 18 and 19, as well as cover assembly 66 with channel 67 with low or null leak. Thus the current generated by the lower face of the propeller, in view of the fins 31 and the basket bottom 26, is taken advantage in the best manner possible reducing hydraulic losses, requiring thus less energy to the propeller 30 to obtain an acceptable current (between one to three liters for every time lapse that the motor is energized in a single sense) that circulates through the filter 15, which is found in the upper part of the water tower 16, given that the cover 66 has a rectangular cut in its upper part in which the filter 15 will be placed.

Figure 12:
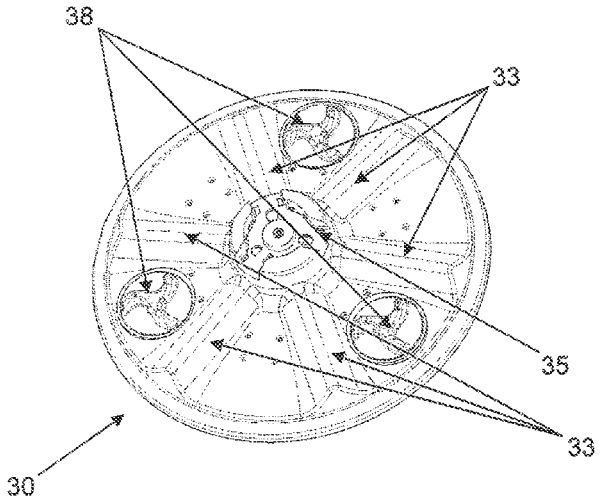
FIG. 12 shows a conventional perspective upper view of a third embodiment of the propeller.

The propeller may also be provided by smaller propellers called mini-propellers 38. These are adapted over the cavities 39 as may be appreciated in FIGS. 12, 13; these cavities are of a slightly bigger diameter than the diameter of the mini-propeller 38, to provide ease to the mini-propeller 38 so that it may freely rotate, actuating as an alternative scrubber for the cloth. Said propellers are inserted in view of concentric holes to cavity 39, through which the grip feet 68 are introduced, which in their free end have a shaft head, which when introduced in a forced manner in the concentric hole of the cavity 39 are bent towards the rotation axis of the mini-propeller and once it has penetrated returns to its rest position, allowing thus to freely rotate the mini-propellers within the cavity 39, as may be seen in FIGS. 11 through 14.

Figure 16:
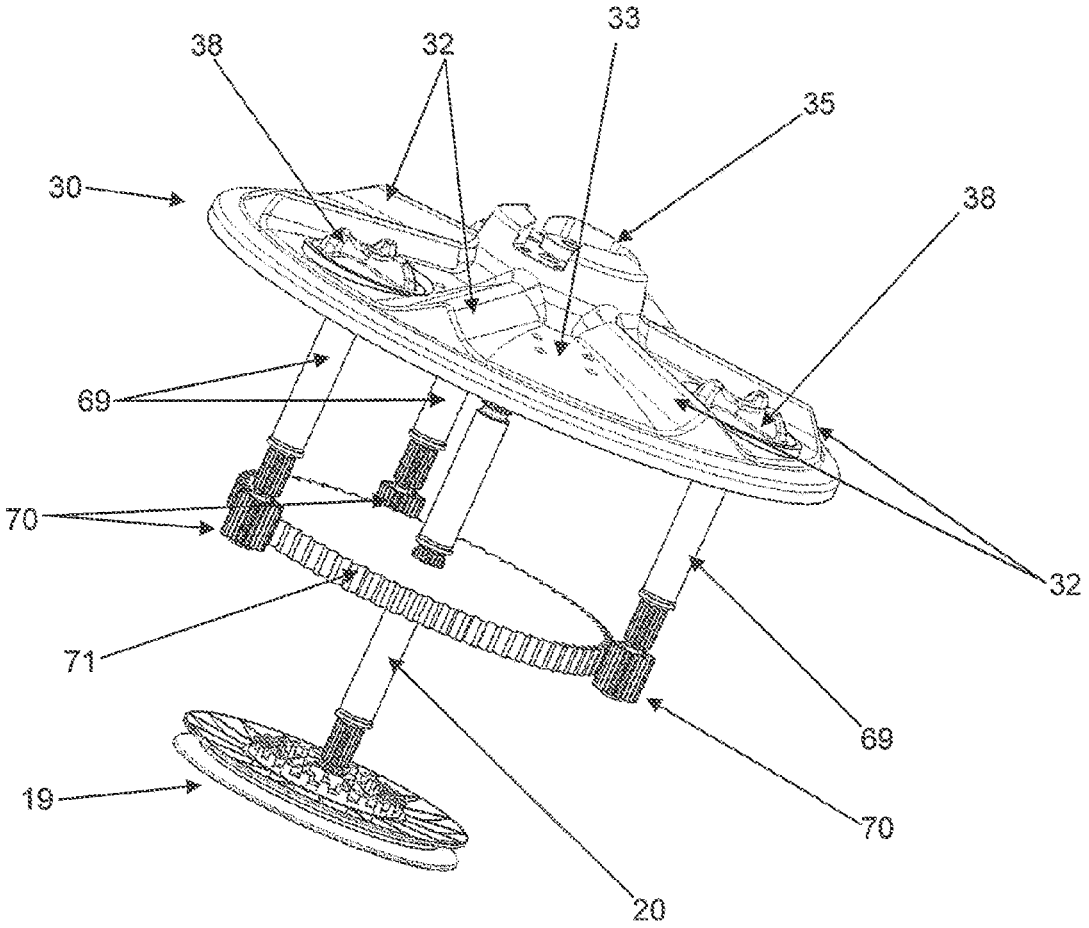
FIG. 16 shows an explosive conventional perspective view of the mini-propeller assembly of the planetary box.

Such as is shown in FIG. 16, in an alternate embodiment of the invention in the lower part of the mini-propellers 38 instead of the grip feet, an axis 69 driven by a planetary gear 70 may be coupled, which at its time is inducted by a solar gear 71, which at its time obtains energy from the driving shaft 20, thus when rotating the driving shaft it provides torque to the propeller 30, as well as providing torque to the mini-propellers 38, generating thus a vortex accompanied with mini-vortexes that allow a greater turbulent flow conferring also an extra scrub to the object to wash.

The mini-propellers may comprise hair or scrubbers that emulate the function of a soft brush, so as to scrub the textiles in the basket being washed. The scrubbers may be integrally formed as offsprings, in cylindrical or parabolic shapes or as a bullet having its tip rounded in all cases, to avoid that the textiles get stuck or are damaged with said scrubbers.

Having disclosed the invention with sufficient detail as well as the best manner to carry out the invention, it is found with a high grade of inventive activity as well as with sufficient novelty, and thus, a technician in the field may reproduce it, and could foresee improvements or variations of the present invention which should fall within the spirit of following claims.

The invention claimed is:

1. In an improved washing machine containing a tub and a basket, which is concentrically placed within said tub, a bottom formed in the basket, a motor coupled to a driving shaft, a propeller located partially within the bottom and impelled by an end of said driving shaft, said propeller containing at least three scrubbers, a center and a support, and a water tower to re-circulate water from the bottom to an upper part of the basket, wherein:

a) the support forms a conic section over which the scrubbers protrude;

b) the propeller has an outer diameter greater than fifteen centimeters (5.91 in);

c) the at least three scrubbers follow a straight projection over an axis, said axis forming an angle θ with the horizontal, oscillating between five to twenty five degrees, the length of the scrubbers is demarked by the propeller outer diameter and the center base diameter;

d) one end of the driving shaft is fitted in the central inferior part of the propeller and the other end of the driving shaft is coupled to a pulley driven by a belt, wherein said belt is driven by a smaller pulley coupled to the motor;

e) the lower face of the propeller has at least one fin, which along with the bottom, makes the function of a centrifugal pump to create a current or washing liquor flow; and f) said current or washing liquor flow is led through said water tower.

2. The washing machine of claim 1, wherein the propeller support has a transverse section formed by a circumference arch with a radius that oscillates between a hundred and forty centimeters to two hundred twenty two centimeters (55.1 in to 87.4 in), with an angle θ which ranges from thirty degrees to eighty degrees.

3. The washing machine of claim 1, wherein the propeller support has a transverse section formed by a straight with a slope with an angle θ of between five to twenty five degrees, said straight joins the outer diameter with the base diameter of the center.

4. The washing machine of claim 1, wherein said water tower comprises in its upper part a filter.

5. The washing machine of claim 1, wherein a window is located in the upper part of the basket for allowing the output of the washing liquor.

6. The washing machine of claim 1, wherein the number of scrubbers is from three to twelve.

7. The washing machine of claim 1, wherein the geometry of the fin is defined in its upper part by the geometry of the support, the length of the fin is constrained by the propeller outer diameter and center diameter, wherein said fin may have a slope with an angle θ.

8. In an improved washing machine containing a tub and a basket, which is concentrically placed within said tub, a bottom formed in the basket, a motor coupled to a driving shaft, a propeller partially located within the bottom and impelled by an end of said driving shaft, said propeller containing at least three scrubbers, a center and a support, and a water tower to re-circulate water from the bottom to an upper part of the basket, wherein:

a) the driving shaft is coupled to a solar gear which rotates at least one satellite gear; wherein one end of the driving shaft is fitted in the central inferior part of the propeller and the other end of the driving shaft is coupled to a pulley driven by a belt, wherein said belt is driven by a smaller pulley coupled to the motor;

b) over an upper face of said support and between the scrubbers, a mini-propeller is provided, wherein said satellite gear is coupled to an axis that rotates said mini-propeller;

c) the support forms a conic section over which the scrubbers protrude;

d) the propeller has an outer diameter greater than fifteen centimeters (5.91 in);

e) the at least three scrubbers follow a straight projection over an axis, said axis forming an angle θ with the horizontal, oscillating between five to twenty five degrees, the length of the scrubbers is demarked by the propeller outer diameter and the center base diameter;

f) a lower face of said propeller has at least one fin, which along with the bottom, has the function of a centrifuge pump to create a current or washing liquor flow; and g) said current or washing liquor flow is led through a water tower.

9. The washing machine of claim 8, wherein the propeller support has a transverse section formed by a circumference arch with a radius that oscillates between a hundred and forty centimeters to two hundred twenty two centimeters (55.1 in to 87.4 in), with a .theta. angle which oscillates between the thirty to eighty degrees.

10. The washing machine of claim 8, wherein the propeller support has a transverse section formed by a straight with a slope with an angle θ of between five to twenty five degrees, said straight joins the outer diameter with the base diameter of the center.

11. The washing machine of claim 8, wherein said water tower comprises in its upper part a filter.

12. The washing machine of claim 8, wherein over an upper face of said support and between the scrubbers, the propeller has at least one circular cavity which houses the mini-propeller, and wherein said axis which is coupled to the satellite gear crosses through said circular cavity, to rotate said mini-propeller.

13. The washing machine of claim 8, wherein said mini-propellers comprise hairs or scrubbers.

14. In an improved washing machine containing a tub and a basket, which is concentrically placed within said tub, a bottom formed in the basket, a motor coupled to a driving shaft, a propeller partially located within the bottom and impelled by an end of said driving shaft, said propeller containing at least three scrubbers, a center and a support, and a water tower to re-circulate water from the bottom to an upper part of the basket, wherein:

a) the propeller has at least one circular cavity over an upper face of the support and between the scrubbers, which houses a mini-propeller;

b) the mini-propeller has a series of grip feet that allow positioning said mini-propeller in a concentric hole provided in the circular cavity;

c) one end of the driving shaft is fitted in the central inferior part of the propeller and the other end of the driving shaft is coupled to a pulley driven by a belt, wherein said belt is driven by a smaller pulley coupled to the motor;

d) the support forms a conic section over which the scrubbers protrude;

e) the propeller as an outer diameter greater than fifteen centimeters (5.91 in);

f) the at least three scrubbers follow a straight projection over an axis, said axis forming an angle PHI with the horizontal, oscillating between five to twenty five degrees, the length of the scrubbers is demarked by the propeller outer diameter and the center base diameter;

g) lower face of said propeller has at least one fin, which along with the bottom, has the function of a centrifuge pump to create a current or washing liquor flow; and h) said current or washing liquor flow is led through a water tower.

15. The washing machine of claim 14, wherein said mini-propellers comprise hairs or scrubbers.

16. The washing machine of claim 14, wherein the mini propellers are inserted in view of concentric holes to cavity.

17. The washing machine of claim 14, wherein the grip feet in their free end have a shaft head, which when introduced in a forced manner in the concentric hole of the cavity are bent towards the rotation axis of the mini-propeller and once it has penetrated returns to its rest position, allowing thus to freely rotate the mini-propellers within the cavity.

18. The washing machine of claim 14, wherein the cavities are of a slightly bigger diameter than the diameter of the mini-propeller to provide ease to the mini-propeller so that it may freely rotate.

* * * * *